US005977523A

United States Patent [19]

Scott

[11] Patent Number: 5,977,523

[45] Date of Patent: Nov. 2, 1999

[54] ELECTRIC HEATING METHOD

[75] Inventor: Richard Charles Scott, Stourport-on-Severn, United Kingdom

[73] Assignee: Ceramaspeed Limited, United Kingdom

[21] Appl. No.: 08/987,371

[22] Filed: Dec. 9, 1997

[30] Foreign Application Priority Data

Jan. 31, 1997 [GB] United Kingdom ..... 9701981

[51] Int. Cl.[6] ..... H05B 3/68

[52] U.S. Cl. ..... 219/452; 219/453; 219/451

[58] Field of Search ..... 219/446, 464, 219/452, 480, 477, 476, 486, 518, 451, 453, 465, 466, 625, 626; 307/116; 340/568; 331/65; 324/236, 207.15

[56] References Cited

FOREIGN PATENT DOCUMENTS

| | | |
|---|---|---|
| 0429120 | 5/1991 | European Pat. Off. . |
| 0620698 | 10/1994 | European Pat. Off. . |
| 3711589 | 10/1988 | Germany . |
| 3934157 | 4/1991 | Germany . |
| 4224934 | 2/1994 | Germany . |

OTHER PUBLICATIONS

European Search Report Oct. 30, 1998.

*Primary Examiner*—Teresa Walberg
*Assistant Examiner*—Shawntina T. Fuqua
*Attorney, Agent, or Firm*—Ira S. Dorman

[57] ABSTRACT

An electric heating method is described for use with a glass-ceramic top cooking appliance. A first sensor coil is provided in a heater associated with a first heating element and a second sensor coil is provided associated with a second heating element, the first and second sensor coils being adapted to provide first and second electrical output signals respectively. Changes in the first and second electrical output signals are monitored resulting from placement and removal of a metallic cooking utensil on and from the cook top and the ratio of change in the first electrical output signal to change in the second electrical output signal is determined. The first heating element is energised alone in accordance with a first predetermined value, or a first predetermined range of values, of the ratio, resulting from placement of a cooking utensil on substantially only an area of the cook top above the first heating element. Both the first and second heating elements are energised together in accordance with a second predetermined value, or a second predetermined range of values, of the ratio, resulting from placement of a cooking utensil on an area of the cook top above both the first and second heating elements.

15 Claims, 4 Drawing Sheets

ELECTRIC HEATING METHOD

This invention relates to an electric heating method for use with electric heaters in glass-ceramic top cooking appliances and involving cooking utensil detection. It is particularly, but not essentially, applicable to radiant electric heaters.

DESCRIPTION OF PRIOR ART

Cooking utensil detection systems are known, for example, from European Patent Publication No. 442,275, European Patent Publication No. 469,189 and European Patent Publication No. 490,289. Such cooking utensil detection systems are arranged to effect automatic energisation and de-energisation of an electric heater located beneath a glass-ceramic cook top when a cooking utensil is respectively placed on and removed from the glass-ceramic cook top. Such detection systems generally operate using inductive techniques, in which a sensor coil is located inside a heater and connected to some form of electrical oscillatory circuit. When a metallic cooking utensil, such as a pot or pan, is placed on the glass-ceramic cook top, overlying the heater, the inductive coupling effect between the utensil and the sensor coil results in a change in output signal from the sensor coil which is processed and used to switch on the heater. A further change in output signal from the sensor coil, when the cooking utensil is subsequently removed from the glass-ceramic cooking surface, is used to effect switching-off of the heater.

Electric heaters are well known which incorporate at least two heating elements, at least one of which is arranged to be independently energised and geometrically arranged with respect to the other or others so as to be capable of optimally heating cooking utensils of various sizes and shapes located on an associated glass-ceramic cook top. Such heaters may comprise a concentric arrangement of heating elements to accommodate cooking utensils of different diameters, or may comprise an oval or rectangular arrangement of multiple heating elements to accommodate cooking utensils of other than circular shape. Heaters of this type are described, for example, in United Kingdom Patent Publication No. 2,044,057. The two or more heating elements each provide particular heating zones on the glass-ceramic cook top and may be separated inside the heater by one or more upstanding walls of insulation material, although this is not essential.

It is desirable to be able to automatically energise the requisite heating element or heating element combinations according to the size and shape of a cooking utensil placed on the glass-ceramic cook top, but problems arise in this regard.

As explained above, when an inductive sensor is used and a metallic cooking utensil is placed on the cook top, a change in inductance occurs in the sensor coil associated therewith and this results in a change in an output signal from the sensor coil. The magnitude of the change in inductance and hence of the change in output signal is dependant upon the nature of the metallic material from which the cooking utensil is made. For example an aluminium cooking utensil, when placed on the cook top, will result in a larger change in inductance than a corresponding cast iron cooking utensil. The outputs of other types of sensor will likewise depend on the characteristics of the different materials of which the utensil can be made. Whilst this may not be a problem in the case of a heater having a single heating element and a single sensor coil, problems arise when attempting to provide a heater, such as one having two concentrically arranged heating elements, in which it is required to automatically energise a central heating element alone when a small metallic cooking utensil is located substantially over it, and to automatically energise both heating elements together when a larger utensil is located substantially over the area of both elements. The provision of two sensor coils, with one sensor coil associated with the central heating element and the other sensor coil associated with the surrounding outer heating element, does not simply in itself solve the problem. Regardless of the size of the cooking utensil being placed on the cook top, the inductance of both sensor coils will be affected. A small utensil, when placed on the cook top, will result in a comparatively large change in inductance in the sensor coil associated with the central heating element and a small change in inductance in the sensor coil associated with the outer heating element. A large utensil, when placed on the cook top, will result in a comparatively large change in inductance in both sensor coils. In theory, monitoring of output signals from the sensor coils would be expected to enable only the central heating element to be automatically energised when a comparatively large change in inductance occurs in the sensor coil associated therewith while a comparatively small change occurs in the sensor coil associated with the outer heating element, as a result of placement of a small utensil. Also, in theory, such monitoring would be expected to enable both heating elements to be automatically energised together when a large change in inductance occurs in the sensor coil associated with the outer heating element.

In practice, however, because of the different effects on inductance produced by cooking utensils of different metallic materials, such monitoring is not satisfactory. For example, a small aluminium utensil, with its relatively high inductance-changing effect, could result in a similar change in inductance in the sensor coil associated with the outer heating element as a large cast iron utensil, with its relatively low inductance-changing effect. This could introduce erroneous operation of the heater in that, in the case of an arrangement set to automatically energise both heating elements upon placement of a large cast iron utensil, operation of both elements, instead of only the central element, would also occur upon placement of a small aluminium utensil.

German Patent Publication No. 3,934,157 describes a cooking appliance in which a multi-ring cooking area is divided into separate zones and sensors are provided to determine the size of a cooking pot placed on the glass-ceramic cook top. A ratio of the total capacitance of two sensors is employed to determine the size of a cooking utensil placed on the cook top. Other types of sensor can be used. There is no consideration of the problem associated with cooking utensils of different materials.

OBJECT OF THE INVENTION

It is an object of the present invention to overcome or minimise this problem.

SUMMARY OF THE INVENTION

The present invention provides an electric heating method for use with a glass-ceramic top cooking appliance and in which energisation and de-energisation of an electric heater in the appliance is automatically effected upon placement and removal respectively of a metallic cooking utensil on and from a glass-ceramic cook top overlying the heater, the method comprising:

providing first and second heating elements in the heater, the first heating element being arranged for selective energising either alone or together with the second heating element, the first heating element being arranged such that, when energised, it heats a first area of the cook top, and the first and second heating elements being arranged such that, when energised together, they heat a second area of the cook top larger than the first area;

providing a first sensor coil in the heater associated with the first heating element and a second sensor coil in the heater associated with the second heating element, the first and second sensor coils being adapted to provide first and second electrical output signals respectively; and monitoring changes in the first and second electrical output signals resulting from placement and removal of a metallic cooking utensil on and from the cook top, wherein the method comprises the further steps of:

determining the ratio of change in the first electrical output signal to change in the second electrical output signal;

energising the first heating element alone in accordance with a first predetermined value, or a first predetermined range of values, of the ratio, resulting from placement of a cooking utensil on substantially only the first area of the cook top;

energising the first and second heating elements together in accordance with a second predetermined value, or a second predetermined range of values, of the ratio, resulting from placement of a cooking utensil on substantially a combination of the first and second areas of the cook top; and de-energising the first heating element, or the first and second heating elements, upon removal of a cooking utensil from the cook top.

The first predetermined value, or range of values, may be above a predetermined target value and the second predetermined value, or range of values, may be below the predetermined target value. The predetermined target value may be in the range from about 2 to about 3.

The first and second sensor coils may be inductive sensor coils.

The first and second sensor coils may be connected in separate electrical oscillatory circuits, preferably operating at different frequencies.

The first and second electrical output signals are preferably electrical output frequency signals or derivatives of electrical output frequency signals.

The changes in the first and second electrical output signals may be changes in electrical output frequency signals or derivatives of such changes.

The first and second sensor coils may be located underneath the first and second heating elements respectively in the heater and may be embedded in thermal and electrical insulation material, such as microporous insulation material, provided underlying the first and second heating elements. The insulation material may serve as a support for the first and second heating elements.

The first and second sensor coils may comprise anodised aluminium wire, or anodised aluminium alloy wire.

The method of the invention is suitably implemented by means of microprocessor-based circuitry.

By means of the method of the invention, involving the determination of the ratio of the changes in electrical output signals from the first and second sensors associated with the first and second heating elements, the nature of the metallic material from which a cooking utensil is made is substantially unimportant with regard to the magnitude of its effect on the output signals from the sensors. Consequently the method operates equally well with large and small utensils of materials such as aluminium which tend to have a large effect on the output signals, and large and small utensils of materials such as cast iron which tend to have a much smaller effect on the output signals.

For a better understanding of the present invention and to show more clearly how it may be carried into effect reference will now be made, by way of example, to the accompanying drawings in which:

DESCRIPTION OF PREFERRED EMBODIMENTS

Figure 1:
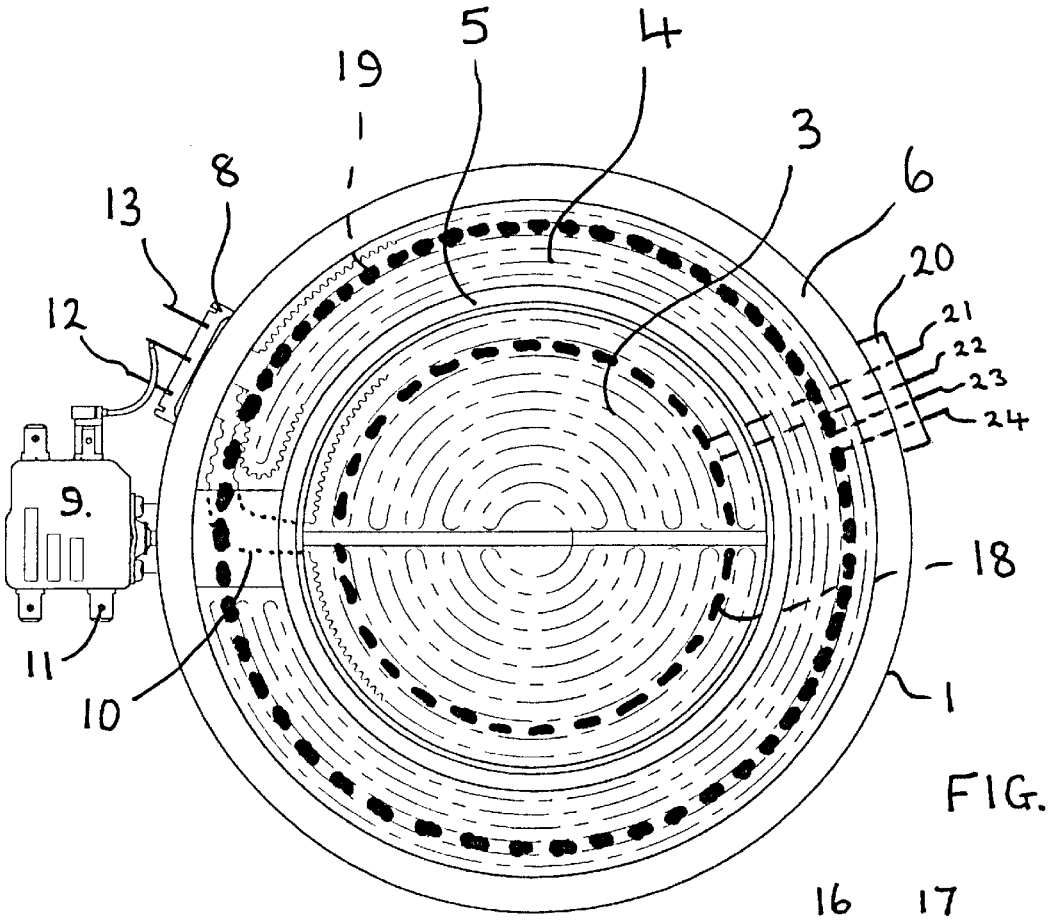
FIG. 1 is a top plan view of a radiant electric heater for use in the heating method according to the invention.
Figure 2:
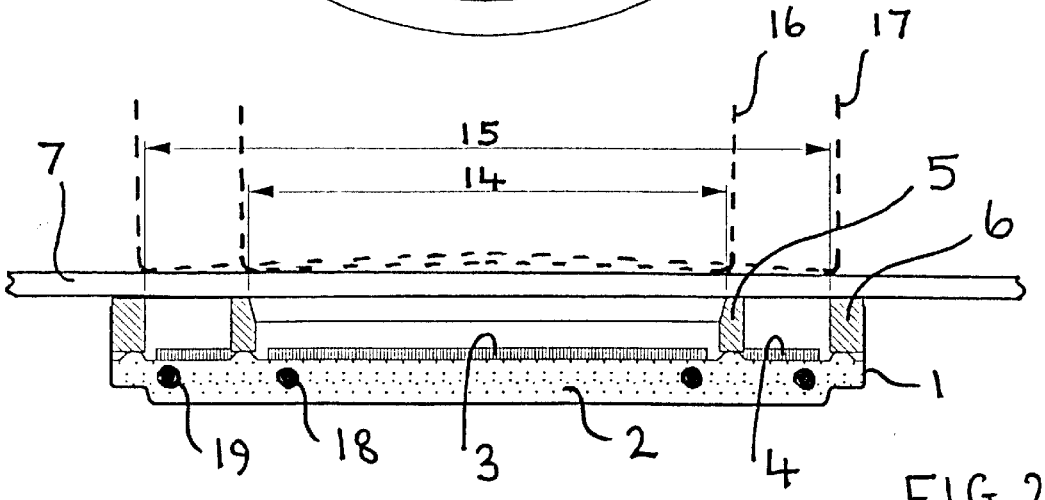
FIG. 2 is a cross-sectional view of the heater of FIG. 1, shown beneath a glass-ceramic cook top.

Referring to FIGS. 1 and 2, a radiant electric heater comprises a metal support dish 1 having therein a layer 2 of thermal and electrical insulation material, such as compacted microporous thermal and electrical insulation material of well known form.

A first electrical heating element 3 of well known form is supported on the insulation layer 2 in a central region of the heater and is arranged concentrically with a surrounding second electrical heating element 4 which is also supported on the insulation layer 2. The heating elements 3 and 4 could, for example, be of corrugated ribbon form arranged on edge and secured by partial embedding in the insulation layer 2.

Alternatively, the heating elements 3 and 4 could be of well known coiled wire form, or one or both of the elements could comprise a halogen lamp. The heating elements 3, 4 need not both be of the same form.

A circular wall 5 of thermal insulation material is provided to form a central heating zone occupied by the first heating element 3 and an outer heating zone occupied by the second heating element 4. A further circular wall 6 of thermal insulation material is provided at the periphery of the heater. The heater is arranged to be supported beneath a cook top 7 of glass-ceramic material, with top surfaces of the walls 5, 6 in contact with the underside of the cook top 7.

A terminal block 8 is provided on the edge of the dish 1, connected to the heating elements 3 and 4 and providing for external connection thereof.

A well known form of rod-shaped thermal limiter 9 extends across the heater and is arranged to de-energise the heater when a pre-determined temperature is reached by the cook top 7.

A block 10 of thermal insulation material is arranged between the dividing wall 5 and the peripheral wall 6. The block 10 is shaped to form a tunnel through which the limiter 9 passes and also terminal tail portions of the first heating element 3 leading to the terminal block 8. The tunnel through the block 10 effectively forms an extension of the central heating zone and also thermally isolates the limiter 9 from the effects of the second heating element 4.

The heater is arranged such that the first heating element 3 is able to be energised alone, by connecting terminals 11 and 12 of the heater to a voltage supply. Alternatively the first and second heating elements 3 and 4 are able to be energised together in parallel, by further connecting terminals 12 and 13 to the voltage supply.

The first heating element 3 is arranged, when energised, to heat a first area 14 of the cook top 7 and the first and second heating elements 3, 4 are arranged, when energised together, to heat a larger second area 15 of the cook top 7. Accordingly, the first heating element 3 will be energised alone to heat a small metallic cooking utensil 16 placed on the cook top 7 and the first and second heating elements 3, 4 will be energised together to heat a larger metallic cooking utensil 17 placed on the cook top 7.

In order to detect placement of a metallic cooking utensil 16 or 17 on the cook top 7 and to effect automatic energisation of either the first heating element 3 alone, or the first and second heating elements 3, 4 together, according to the size of a cooking utensil 16 or 17 being placed, the following arrangement is provided.

Figure 3:
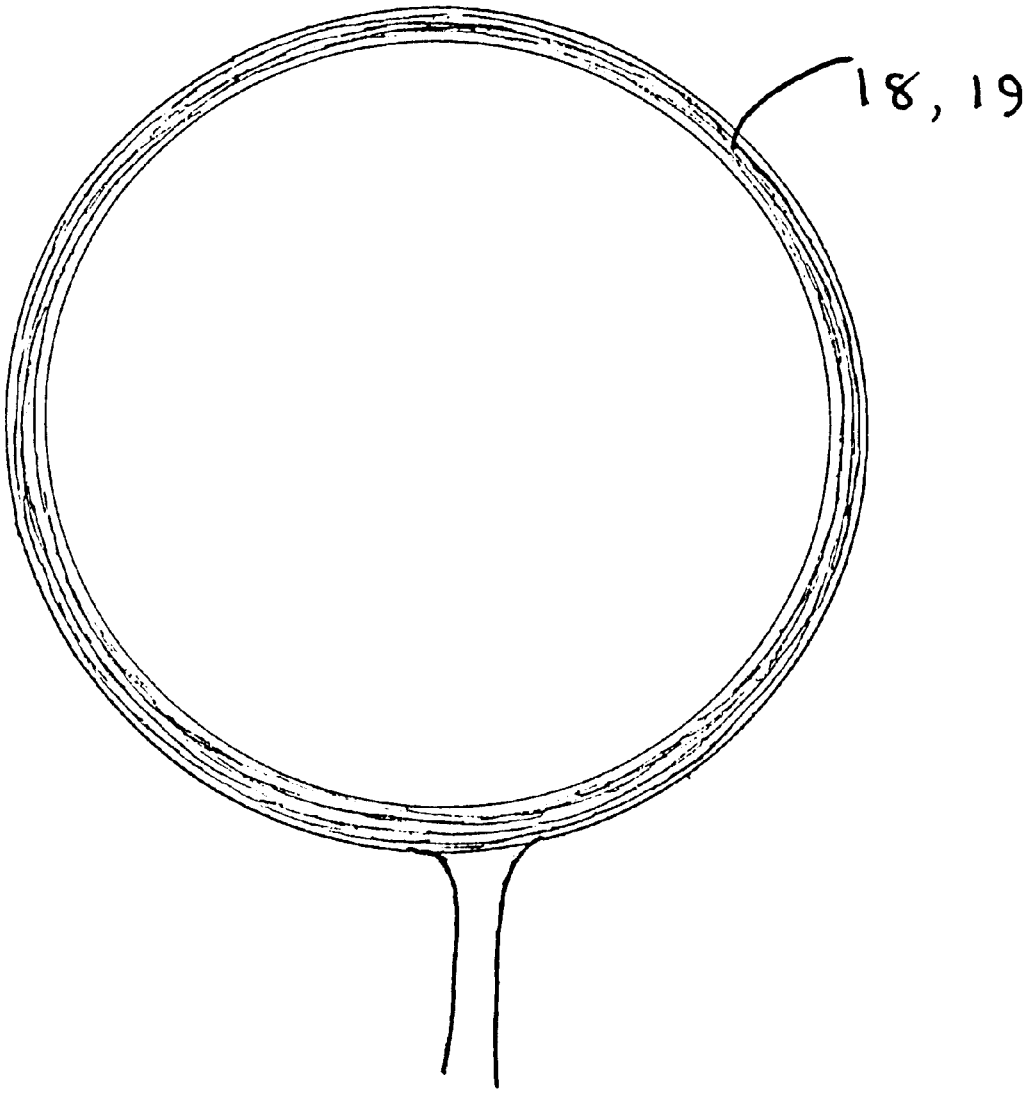
FIG. 3 is a plan view of a sensor coil for use in the heater of FIGS. 1 and 2.

A first inductive sensor coil 18, comprising a number of turns of wire without a core or former, as shown in FIG. 3, is provided embedded in the insulation layer 2, underneath the first heating element 3.

A second inductive sensor coil 19, comprising a number of turns of wire without a core or former, is provided embedded in the insulation layer 2, underneath the second heating element 4. The second coil 19 is similar to, but of larger diameter than, the first coil 18 shown in FIG. 3. The first and second sensor coils 18, 19 suitably comprise anodised aluminium wire, or anodised aluminium alloy wire, although other wire material may also be used. The use of such anodised aluminium or aluminium alloy wire as a sensor coil is described in United Kingdom Patent Application No. 9626356.1.

A terminal block 20 is provided on the edge of the dish 1, the ends of the first sensor coil 18 being connected to terminals 21 and 22 and the ends of the second sensor coil 19 being connected to terminals 23 and 24.

Figure 6:
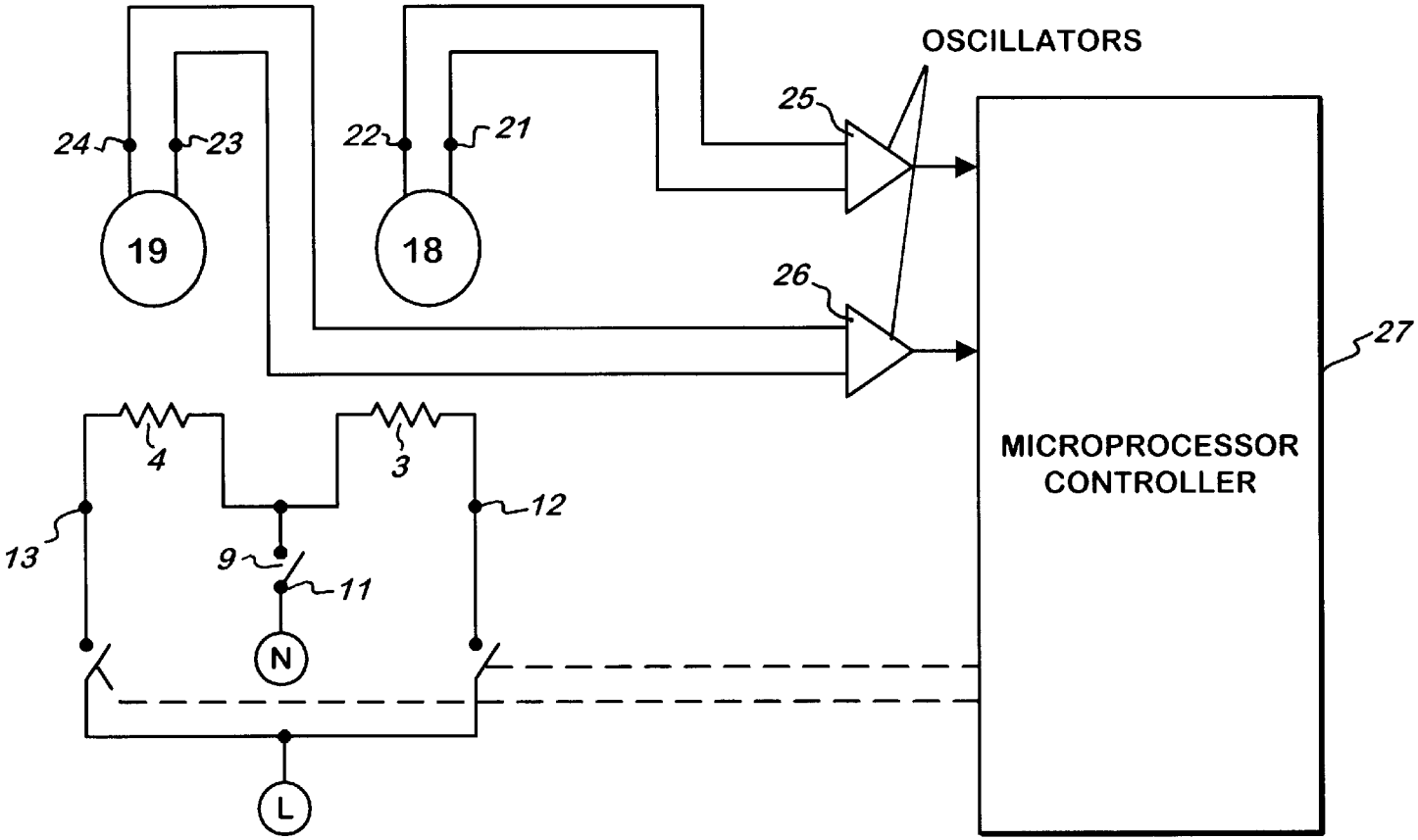
FIG. 6 is a schematic diagram showing oscillatory and microprocessor-based circuitry suitable for use in the practice of the present invention.
Figure 1:
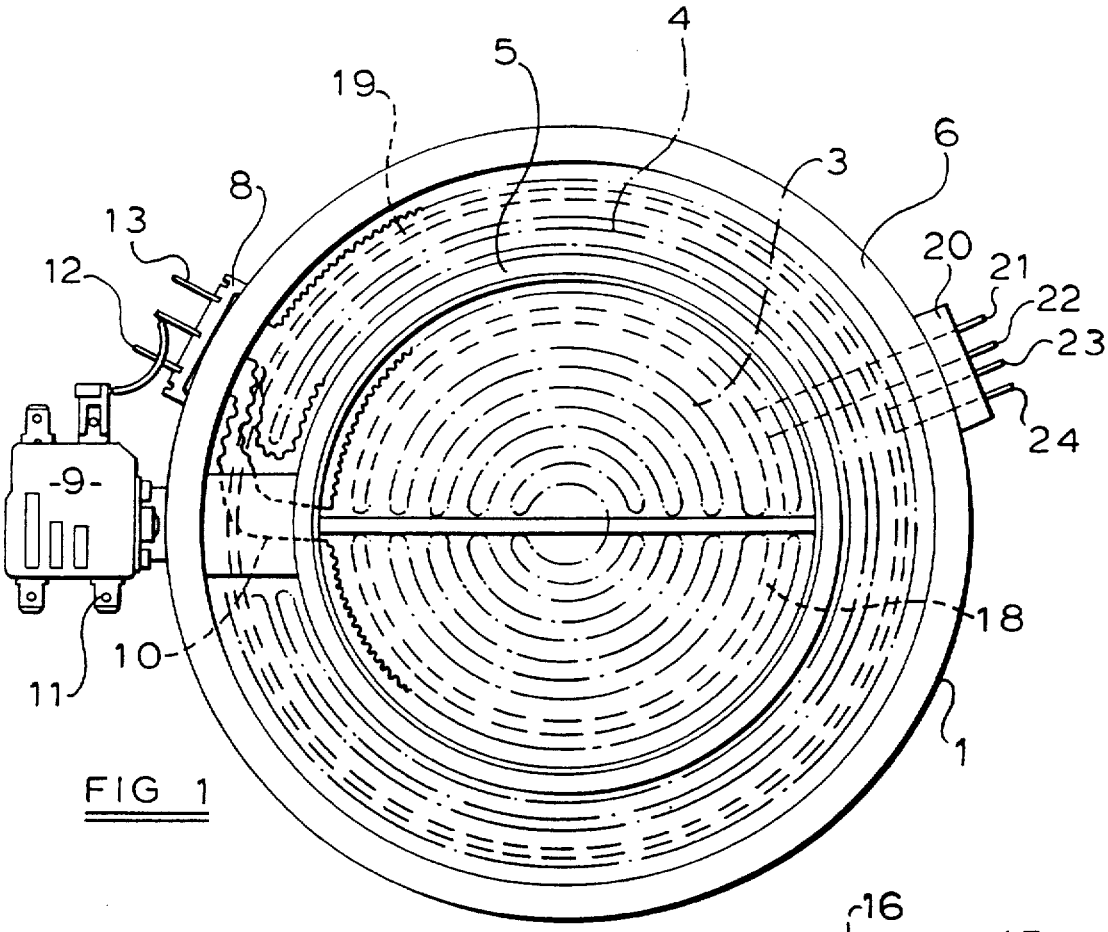
Figure 2:
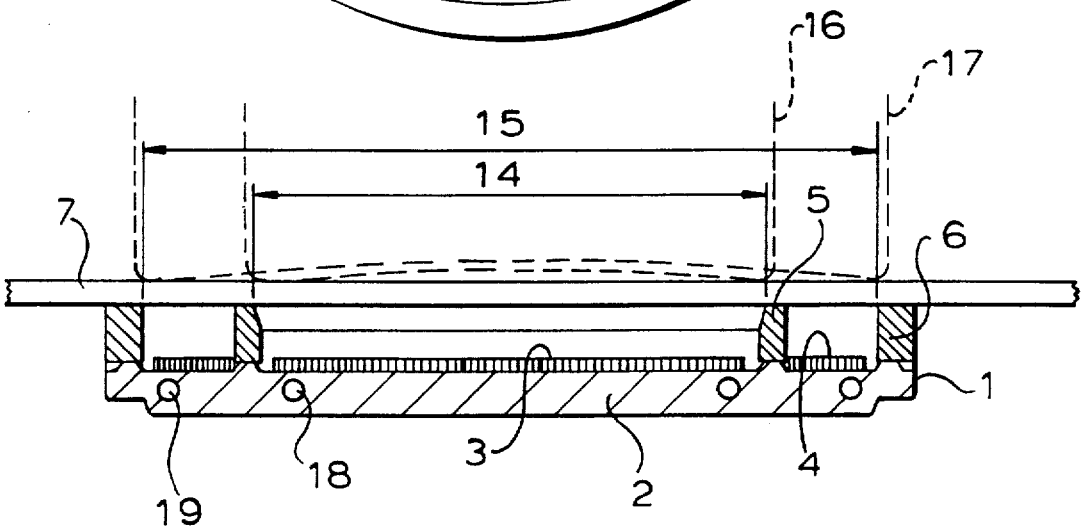
Figure 3:
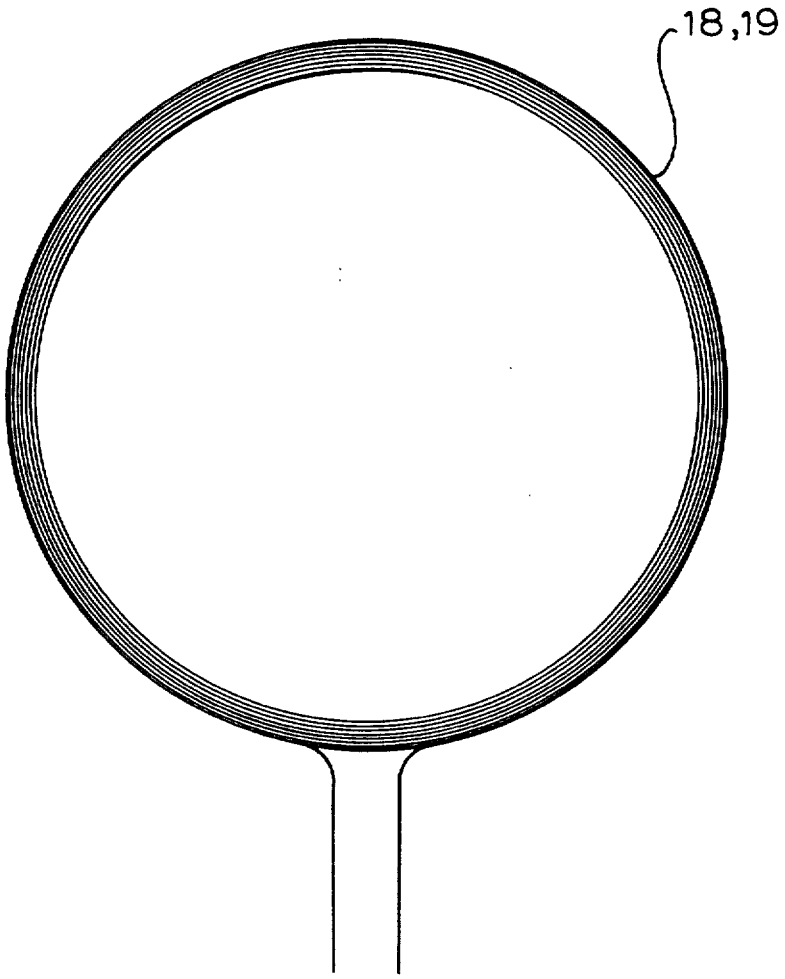
Figure 4:
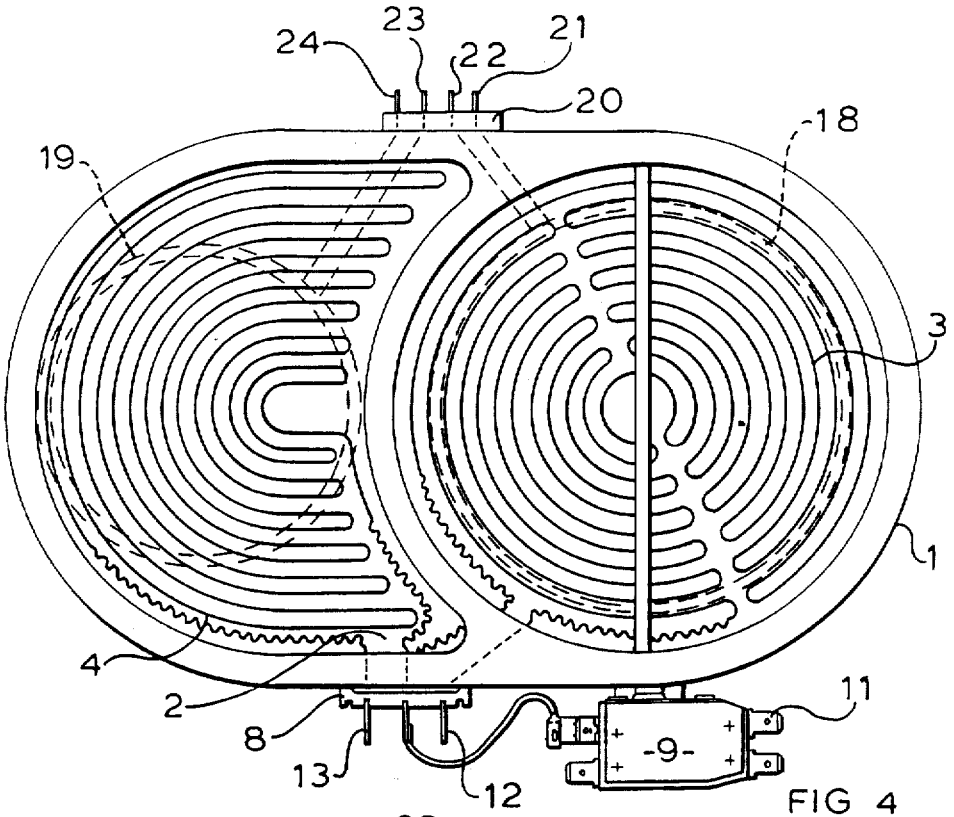
Figure 5:
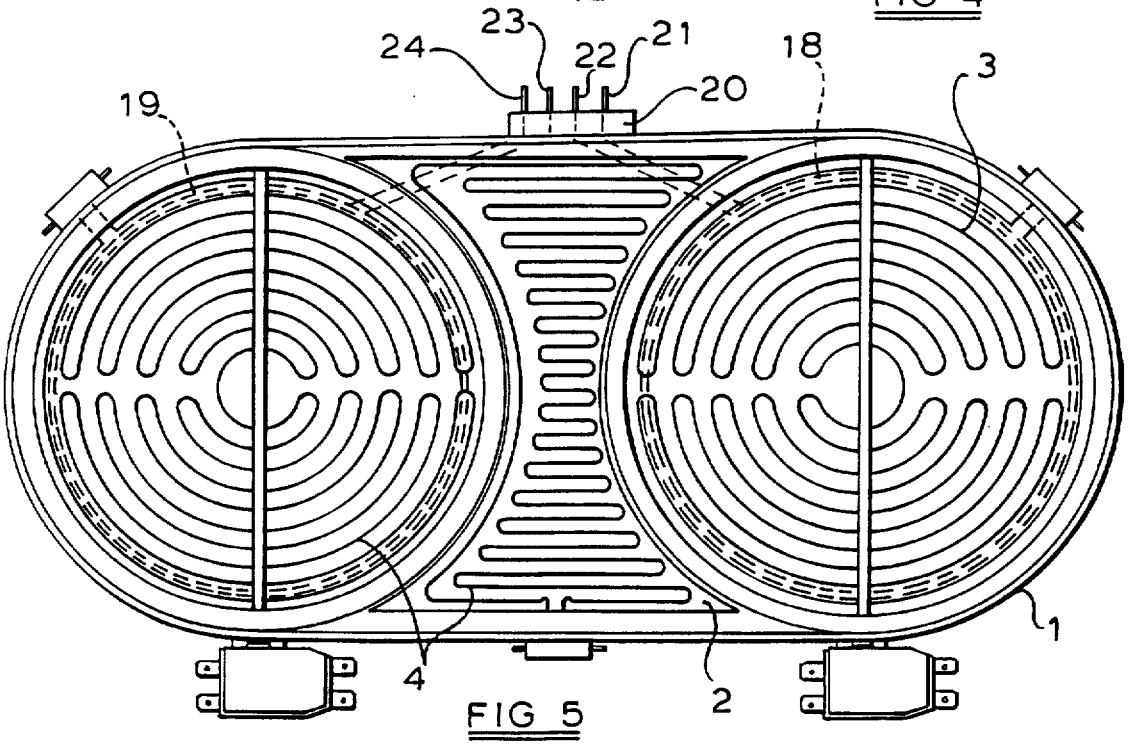

The sensor coils 18 and 19 are electrically connected to separate electrical oscillatory circuits of well known form operating at different nominal frequencies, such as 80 KHz and 120 KHz respectively, and such that a first electrical output frequency signal is obtained from the first sensor coil 18 and a second electrical output frequency signal is obtained from the second sensor coil 19. As is seen in FIG. 6, the terminals 21 and 22 are connected to a first oscillator 25 and the terminals 23 and 24 are connected to a second oscillator 26. Signals from the separate oscillators 25 and 26 are fed to a microprocessor controller 27, which is operative to selectively connect and disconnect terminals 11, 12, and 13 to a voltage supply (line "L" and neutral "N") to energise either heating element 3 alone or elements 3 and 4 in parallel, as described.

The electromagnetic field distribution resulting from the two sensor coils 18, 19 will, in fact, overlap. That is, when a small cooking utensil 16 is placed over the first area 14 of the cook top, the placing of the utensil will result in an output frequency signal change from both the first and second sensor coils 18, 19. The magnitude of such an output frequency signal change resulting from placement of the small cooking utensil 16 on the cook top is larger for the first sensor coil 18 than for the second sensor coil 19.

When a large cooking utensil 17 is placed over the second, larger, area 15 of the cook top, changes in output frequency signals of large magnitude result from both the first and second sensor coils 18, 19.

Unfortunately it is not satisfactory to use the individual measured amplitude values of the change in the output frequency signals for the sensor coils 18 and 19 to determine whether a large or a small utensil has been placed and to use such measured values to determine whether heating elements 3 and 4 should be energised together, to heat a large utensil, or whether the heating element 3 should be energised alone to heat a small utensil. The reason for this is the different materials from which cooking utensils are manufactured and their correspondingly different magnetic inductive effects on the sensor coils 18, 19. For example placement of a small utensil 16 of aluminium may result in a change in output frequency signal for the second sensor coil 19 of similar magnitude to the change resulting from placement of a large utensil 17 of cast iron, because of the different inductive effects of these two metal materials. Consequently, based on selection of a predetermined threshold value for a change in the output frequency signal for the second sensor coil 19 and which, when exceeded, would determine that both heating elements 3, 4 should be energised, then erroneous energisation of both heating elements 3, 4 together would occur when the small aluminium pan was placed on the cook top, rather than energisation alone of the heating element 3. Increasing the threshold value for the change in output frequency signal for the second sensor coil 19 would not be satisfactory, although the effectively reduced sensitivity would prevent the placement of the small aluminium pan from implementing energisation of both heating elements 3 and 4. Unfortunately, however, placement of a large utensil 17 comprising cast iron on the cook top would then not result in a sufficiently large change in the output frequency signal for the second sensor coil 19 for the predetermined threshold value to be exceeded and energisation of both heating elements would not be effected.

The solution to this problem according to the method of the present invention is to monitor the ratio between the change in output frequency signal of the first sensor coil 18 and the change in output frequency signal of the second sensor coil 19. Such a ratiometric measurement has been found to provide good correlation with cooking utensil size, regardless of the absolute levels of change of the output signals for the first and second sensor coils 18, 19 and regardless of the nature of the materials comprising the cooking utensils.

In the method of the invention, when a cooking utensil 16 or 17 is placed on the cook top 7, changes in first and second output frequency signals for the first and second sensor coils 18 and 19 respectively are monitored.

The ratio of the change in the first signal to the change in the second signal is determined and if this ratio is in accordance with a first predetermined value, or a first predetermined range of values, energisation of the first heating element 3 alone is effected. Such first predetermined value, or range of values, for the ratio, is selected according to the placement of a small cooking utensil 16 in substantially the area 14 of the cook top 7.

If the ratio of the change in the first signal to the change in the second signal is in accordance with a second predetermined value, or a second predetermined range of values, energisation of the first and second heating elements 3, 4 together is effected. Such second predetermined value, or range of values, for the ratio, is selected according to the placement of a large cooking utensil 17 in substantially the area 15 of the cook top 7.

When cooking utensil 16 or 17 is removed from the cook top, changes in the first and second output signals for the sensor coils 18, 19 in the opposite sense from those resulting from placement of the cooking utensil are monitored and used to implement de-energisation of heating element 3 or heating elements 3 and 4 as appropriate.

The first and second predetermined values, or ranges of values, for the changes in the first and second output frequency signals can readily be determined by experimentation and in themselves require no inventive activity.

In practice, it has been found that ratio of the change between the first and second signals can be characterised by a target value. The target value varies depending on the construction of the heater, but is generally in the range from about 2 to about 3. If the ratio is above the target value a small cooking utensil 16 has been placed in substantially the area 14 of the cook top 7. However, if the ratio is below the target value a large cooking utensil 17 has been placed in substantially the area 15 of the cook top 7.

Figure 4:
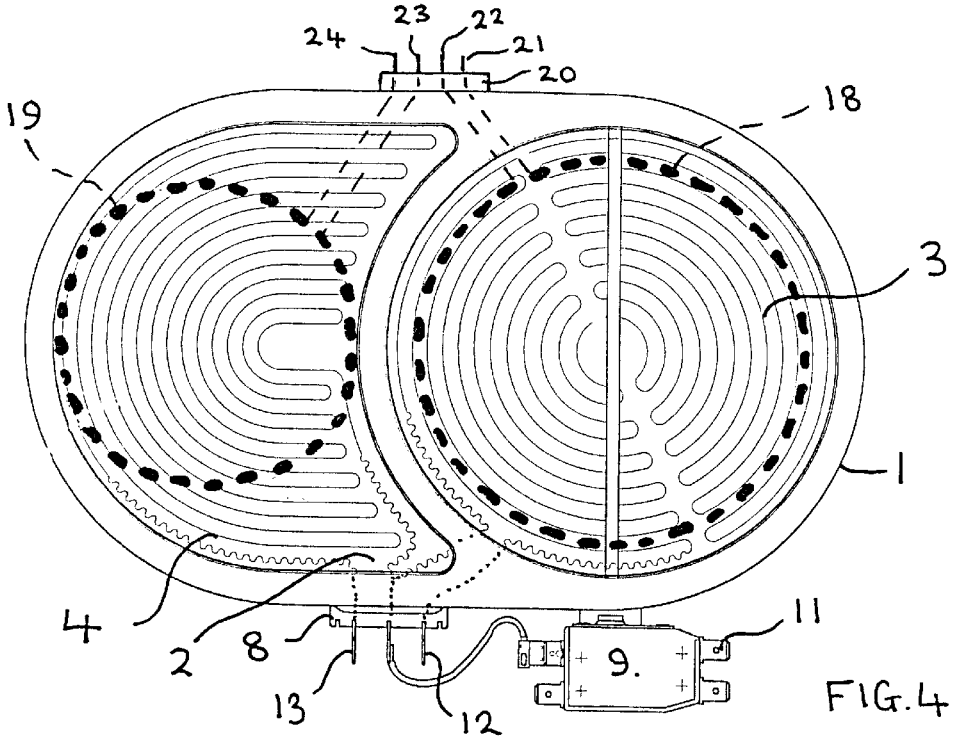
FIGS. 4 and 5 are top plan views of other forms of radiant heaters for use in the heating method according to the invention.
Figure 5:
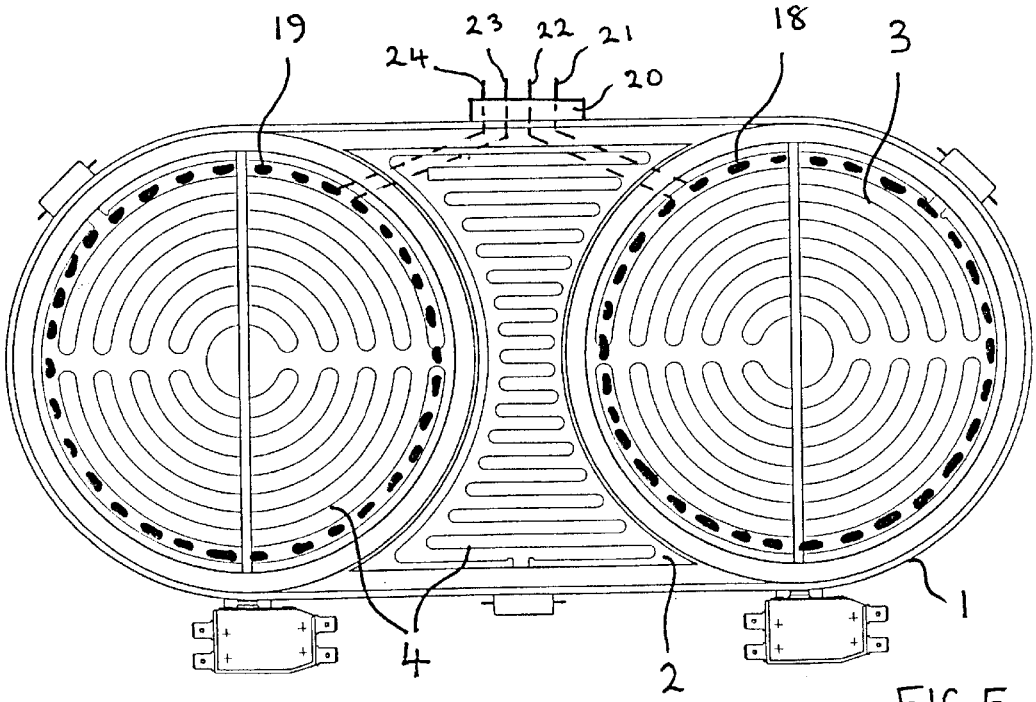

Although the method of the invention has been specifically described herein with reference to a heater having two concentrically arranged heating elements, it will be apparent to the skilled person that it can be equally applied to other embodiments of heaters. Examples of other embodiments are illustrated in FIGS. 4 and 5. In FIG. 4, an oval heater arrangement is depicted, having a first heating element 3 and a second heating element 4. A first inductive sensor coil 18 is embedded in insulation material 2, beneath the first heating element 3 and a second inductive sensor coil 19 is embedded in the insulation material 2, beneath the second heating element 4.

In FIG. 5, a so-called bridged heater arrangement of well known form is depicted, having a first heating element 3 and second heating elements 4. First and second inductive sensor coils 18 and 19 are embedded in insulation material, beneath the first and second heating elements 3, 4 respectively.

The arrangements of FIGS. 4 and 5 are operated in the same manner as previously described with reference to FIGS. 1 and 2, heating element 3 being energised alone in each case when a small cooking utensil is placed substantially over the area thereof and heating elements 3 and 4 being energised together when a larger, elongated, cooking utensil is placed substantially over the combined areas of elements 3 and 4. In the same way as described with reference to FIGS. 1 and 2, determination of the value, or range of values, of the ratio of the change in output frequency signal for the first sensor coil 18 to the change in output frequency signal for the second sensor coil 19 is used to implement energisation of heating element 3 alone, or heating elements 3 and 4 together, according to the size of the cooking utensil being placed.

Instead of electrical output frequency signals and changes thereof being monitored for the sensor coils, derivatives of such signals and of such changes thereof could be monitored.

Arrangements involving heaters as in FIGS. 1 to 6, having sensor coils 18, 19 located beneath the heating elements 3, 4, can be subject to magnetic influence of the heating elements on the output signals from the sensor coils. Such influence changes when the heating elements heat up to a temperature above their Curie temperature. Below the Curie temperature the elements are ferromagnetic and above the Curie temperature the elements are substantially non-ferromagnetic. A method for processing the output signals to address this problem is described in United Kingdom Patent Application No. 9626355.3.

I claim:

1. An electric heating method for use with a glass-ceramic top cooking appliance and in which energisation and de-energisation of an electric heater in the appliance is automatically effected upon placement and removal respectively of a metallic cooking utensil on and from a glass-ceramic cook top overlying the heater, the method comprising:

providing first and second heating elements in the heater, the first heating element being arranged for selective energisation either alone or together with the second heating element, the first heating element being arranged such that, when energised, it heats a first area of the cook top, and the first and second heating elements being arranged such that, when energised together, they heat a second area of the cook top larger than the first area;

providing a first sensor coil in the heater associated with the first heating element and a second sensor coil in the heater associated with the second heating element, the first and second sensor coils being adapted to provide first and second electrical output signals respectively;

monitoring changes in the first and second electrical output signals resulting from placement and removal of a metallic cooking utensil on and from the cook top;

determining the ratio of change in the first electrical output signal to change in the second electrical output signal;

energising the first heating element alone in accordance with one of a first predetermined value and a first predetermined range of values of the ratio, resulting from placement of a cooking utensil on substantially only the first area of the cook top;

energising the first and second heating elements together in accordance with one of a second predetermined value and a second predetermined range of values of the ratio, resulting from placement of a cooking utensil on substantially a combination of the first and second areas of the cook top; and de-energising the first heating element, or the first and second heating elements, upon removal of a cooking utensil from the cook top.

2. A method according to claim 1, wherein the one of the first predetermined value and first predetermined range of values is above a predetermined target value and the one of the second predetermined value and second predetermined range of values is below the predetermined target value.

3. A method according to claim 2, wherein the predetermined target value is in the range from about 2 to about 3.

4. A method according to claim 1, wherein the first and second sensor coils are inductive sensor coils.

5. A method according to claim 4, wherein the first and second sensor coils are connected in separate oscillatory circuits.

6. A method according to claim 5, wherein the separate oscillatory circuits operate at different frequencies.

7. A method according to claim 1, wherein the first and second electrical output signals are selected from electrical output frequency signals and derivatives of electrical output frequency signals.

8. A method according to claim 1, wherein the changes in the first and second electrical output signals are changes in electrical output frequency signals or derivatives of such changes.

9. A method according to claim 1, wherein the first and second sensor coils are located underneath the first and second heating elements respectively in the heater.

10. A method according to claim 9, wherein the first and second sensor coils are embedded in thermal and electrical insulation material provided underlying the first and second heating elements.

11. A method according to claim 10, wherein the insulation material comprises microporous insulation material.

12. A method according to claim 10, wherein the insulation material serves as a support for the first and second heating elements.

13. A method according to claim 1, wherein the material of the first and second sensor coils is selected from the group consisting of anodised aluminium wire and anodised aluminium alloy wire.

14. A method according to claim 1, wherein the method is implemented by means of microprocessor-based circuitry.

15. A glass-ceramic top cooking appliance implemented with an electric heating method according to claim 1.

* * * * *

UNITED STATES PATENT AND TRADEMARK OFFICE

CERTIFICATE OF CORRECTION

PATENT NO. : 5,977,523
DATED : November 2, 1999
INVENTOR(S) : Richard Charles Scott It is certified that error appears in the above-identified patent and that said Letters Patent is hereby corrected as shown below:

The Title page should be deleted and substitute therefor the attached Title page.

Drawings:

Delete sheets 1-5, and substitute therefor the Drawing sheets, consisting of Figs. 1-5, as shown on the attached pages.

Signed and Sealed this

Twenty-seventh Day of June, 2000

*Attest:*

Q. TODD DICKINSON

*Attesting Officer*

*Director of Patents and Trademarks*

US005977523A

United States Patent [19]

Scott

[11] Patent Number: 5,977,523

[45] Date of Patent: Nov. 2, 1999

[54] ELECTRIC HEATING METHOD

[75] Inventor: Richard Charles Scott, Stourport-on-Severn, United Kingdom

[73] Assignee: Ceramaspeed Limited, United Kingdom

[21] Appl. No.: 08/987,371

[22] Filed: Dec. 9, 1997

[30] Foreign Application Priority Data

Jan. 31, 1997 [GB] United Kingdom ..... 9701981

[51] Int. Cl.[6] ..... H05B 3/68

[52] U.S. Cl. ..... 219/452; 219/453; 219/451

[58] Field of Search ..... 219/446, 464, 219/452, 480, 477, 476, 486, 518, 451, 453, 465, 466, 625, 626; 307/116; 340/568; 331/65; 324/236, 207.15

[56] References Cited

FOREIGN PATENT DOCUMENTS

| | | |
|---|---|---|
| 0429120 | 5/1991 | European Pat. Off. . |
| 0620698 | 10/1994 | European Pat. Off. . |
| 3711589 | 10/1988 | Germany . |
| 3934157 | 4/1991 | Germany . |
| 4224934 | 2/1994 | Germany . |

OTHER PUBLICATIONS

European Search Report Oct. 30, 1998.

*Primary Examiner*—Teresa Walberg
*Assistant Examiner*—Shawntina T. Fuqua
*Attorney, Agent, or Firm*—Ira S. Dorman

[57] ABSTRACT

An electric heating method is described for use with a glass-ceramic top cooking appliance. A first sensor coil is provided in a heater associated with a first heating element and a second sensor coil is provided associated with a second heating element, the first and second sensor coils being adapted to provide first and second electrical output signals respectively. Changes in the first and second electrical output signals are monitored resulting from placement and removal of a metallic cooking utensil on and from the cook top and the ratio of change in the first electrical output signal to change in the second electrical output signal is determined. The first heating element is energised alone in accordance with a first predetermined value, or a first predetermined range of values, of the ratio, resulting from placement of a cooking utensil on substantially only an area of the cook top above the first heating element. Both the first and second heating elements are energised together in accordance with a second predetermined value, or a second predetermined range of values, of the ratio, resulting from placement of a cooking utensil on an area of the cook top above both the first and second heating elements.

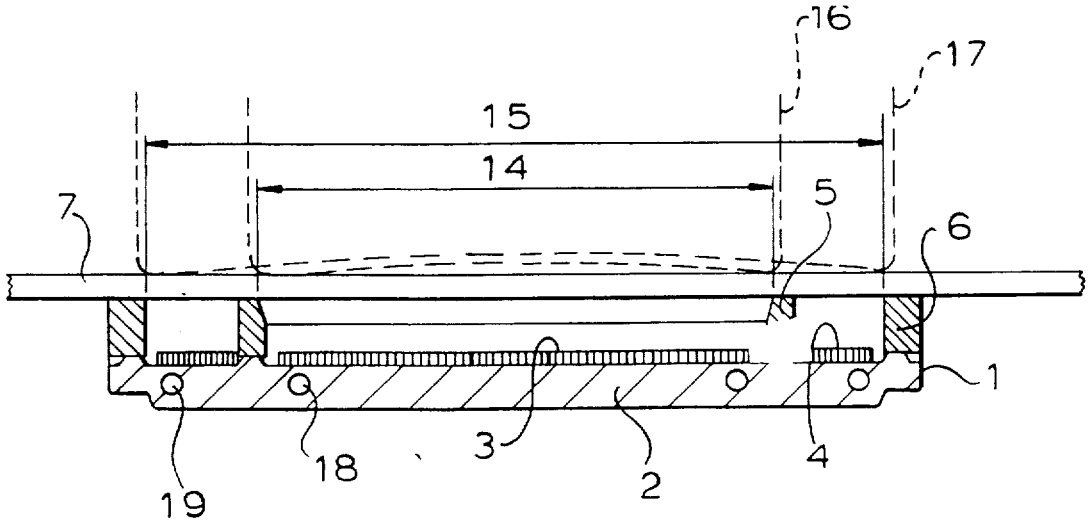

15 Claims, 4 Drawing Sheets